US007213401B2

(12) United States Patent
Jeuch et al.

(10) Patent No.: US 7,213,401 B2
(45) Date of Patent: May 8, 2007

(54) SELF-REFRIGERATING PACKAGING AND ASSOCIATED ACTUATION DEVICE

(75) Inventors: Pierre Jeuch, Saint-Aubin (FR); Lionel Frantz, Paris (FR); Fadi Khairallah, Versailles (FR)

(73) Assignee: Thermagen, Gif-sur-Yvette (FR)

( * ) Notice: Subject to any disclaimer, the term of this patent is extended or adjusted under 35 U.S.C. 154(b) by 179 days.

(21) Appl. No.: 10/505,858

(22) PCT Filed: Feb. 20, 2003

(86) PCT No.: PCT/FR03/00559

§ 371 (c)(1),
(2), (4) Date: Sep. 21, 2004

(87) PCT Pub. No.: WO03/073019

PCT Pub. Date: Sep. 4, 2003

(65) Prior Publication Data

US 2005/0160745 A1 Jul. 28, 2005

(30) Foreign Application Priority Data

Feb. 28, 2002 (FR) ..... 02 02521

(51) Int. Cl.
*B65B 63/08* (2006.01)

(52) U.S. Cl. ..... 62/60; 62/294

(58) Field of Classification Search ..... 62/4, 62/293, 294, 371, 457.3, 457.4, 457.9, 60; 426/109; 206/222
See application file for complete search history.

(56) References Cited

U.S. PATENT DOCUMENTS 3,726,106 A 4/1973 Jaeger
3,970,068 A * 7/1976 Sato ..... 126/263.08
4,204,408 A 5/1980 Dawson
4,773,389 A * 9/1988 Hamasaki ..... 126/263.07
4,928,495 A * 5/1990 Siegel ..... 62/4
5,168,708 A * 12/1992 Siegel ..... 62/4
5,230,216 A * 7/1993 Siegel ..... 126/263.01

(Continued)

FOREIGN PATENT DOCUMENTS

EP 0 726 433 A1 8/1996

(Continued)

OTHER PUBLICATIONS

"Endothermic Cooling Cartridge", Nov. 1, 1994, IBM Technical Disclosure Bulletin, IBM Corp., New York, US, pp. 567-571, XP000487340.

*Primary Examiner*—Mohammad M. Ali
(74) *Attorney, Agent, or Firm*—Sughrue Mion, PLLC

(57) ABSTRACT

The invention relates to self-refrigerating beverage packaging comprising: a first cavity (10) which contains a beverage; a second cavity (20) which forms a heat exchanger and which contains a refrigerating liquid and the vapour thereof; a third cavity (30) which contains means for the adsorption pumping of said vapour and means of connecting (40) the second cavity with the third cavity. The inventive packaging is characterised in that the second and third cavities are provided with a common wall (25) comprising the built-in connection means, and in that said connection means (40) comprise a check valve (42) which can withstand pressure exerted on the side of the second cavity and which opens under the effect of a force exerted on the side of the third cavity.

17 Claims, 8 Drawing Sheets

U.S. PATENT DOCUMENTS

| | | | | |
|---|---|---|---|---|
| 5,233,836 | A | 8/1993 | Siegel | |
| 5,331,817 | A * | 7/1994 | Anthony | 62/5 |
| 5,359,861 | A | 11/1994 | Maier-LaxHuber | |
| 5,626,022 | A * | 5/1997 | Scudder et al. | 62/4 |
| 5,655,384 | A * | 8/1997 | Joslin, Jr. | 62/294 |
| 6,103,280 | A * | 8/2000 | Molzahn et al. | 426/109 |
| 6,141,970 | A * | 11/2000 | Molzahn et al. | 62/4 |
| 6,178,753 | B1 * | 1/2001 | Scudder et al. | 62/4 |
| 6,338,252 | B1 * | 1/2002 | Calderaio | 62/4 |
| 6,341,491 | B1 * | 1/2002 | Paine et al. | 62/4 |

FOREIGN PATENT DOCUMENTS

| | | | |
|---|---|---|---|
| EP | 1 143 210 | A1 | 10/2001 |
| EP | 1 154 208 | A1 | 11/2001 |
| FR | 528 092 | A | 11/1921 |
| JP | 5-211946 | A * | 8/1993 |
| WO | WO 99/37958 | A1 | 7/1999 |
| WO | WO 01/11297 | A1 | 2/2001 |
| WO | WO 03/041841 | A1 | 5/2003 |
| WO | WO 03/073019 | A1 | 9/2003 |

* cited by examiner

SELF-REFRIGERATING PACKAGING AND ASSOCIATED ACTUATION DEVICE

BACKGROUND OF THE INVENTION

The present invention relates to a container which allows its contents to be cooled by an evaporation and adsorption method. The principle of a such a cooling method consists of evaporating a liquid, called refrigerant, under the action of a depression maintained by pumping the vapors of said liquid. The invention applies to the cooling of food products such as beverages, ice creams, but also to non-food products such as pharmaceuticals or cosmetics.

The invention applies quite particularly to the cooling of a beverage contained in a closed container of can or bottle type.

An aim of the present invention is therefore to allow the consumption of a beverage at an ideal temperature in any place and at any time.

The implementation of the method of cooling by evaporation and adsorption is known and has been the subject of numerous research programmes in the prior art. Numerous devices have been proposed, combining a heat exchanger containing a liquid to be evaporated with a reservoir containing an adsorbent, in particular for applications to self-cooling beverage containers.

Thus, U.S. Pat. No. 4,928,495, an illustration of which is given in FIG. 1, discloses a self-cooling container configuration 10 (presented as a can) comprising a heat exchanger 16 of flattened rectangular shape immersed in a beverage to be cooled and connected to an adsorption device 22. This patent discloses an outline scheme without specifying the means of producing such a device taking account of the economic constraints associated with an application to disposable containers.

Moreover, International Patent Application WO 01/11297, an illustration of which is given in FIG. 2a, also discloses a self-cooling beverage container and specifies the geometry of the heat exchanger as well as the manufacturing and assembly process of such a device which is compatible with the industrial constraints of high output volumes.

The beverage container described in this International Application is constituted by a closed first can 10 containing the consumer beverage and a heat exchanger 20 and a closed second can 30 containing desiccants 24. The two cans are assembled by a ring 29. Communication means 40 between said two cans must be actuated by a porous spike 44 to allow implementation of the cooling method by evaporation adsorption of the vapors of a refrigerant contained in the exchanger. These communication means, a detailed illustration of which is given in FIG. 2*b*, comprise a seal 66 comprising two membranes 70 and 71 arranged opposite each other in the walls of the first and second cans of the container respectively. The porous spike 44 makes it possible to tear the seal 66 so as to connect the desiccants reservoir 30 to the heat exchanger 20, thus triggering the evaporation reaction by adsorption and cooling the beverage.

This document also discloses the manufacturing process of such a self-cooling beverage container and in particular the assembly stages of the different elements constituting the container. The assembly stage of the first can 10, containing the beverage and the heat exchanger 20, with the can 30 containing the desiccants is particularly delicate as it is essential to maintain a high vacuum in the desiccants reservoir 30 and at the seal 66 so that the adsorption reaction can be actuated during tearing of the membranes 70 and 71.

To this end, Application WO01/11297 proposes to place a drop of oil 73 between the two membranes 70 and 71 in order to guarantee a good tightness of the vacuum during assembly of the two cans.

However, the self-cooling beverage container as well as the process described in this Application WO01/11297 have certain drawbacks. In particular, the system of connecting the desiccants reservoir 30 to the heat exchanger 20 is not optimized. In fact, the two membranes 70 and 71 each have a relatively substantial thickness which is essential in resisting the external atmospheric pressure before assembly of the container. Moreover, these two membranes 70 and 71 constitute a double thickness which requires a major rupture force. To this end, the Patent Application specifies that the porous spike element 44 is actuated using a screw. Moreover, the production of such a seal 66 complicates assembly of the container, in particular with the requirement to keep the interstice between the two membranes 70 and 71 under air vacuum, when one of them turns relative to the other.

SUMMARY OF THE INVENTION

The aim of the present invention is overcome the drawbacks of the prior art To this end, the present invention sets out to produce a self-cooling container based on the method of cooling by evaporation and adsorption as previously described and to provide communication means between the desiccants reservoir and the heat exchanger in a wall common to said reservoir and exchanger. The communication means are constituted by a non-return valve, i.e. one which resists a strong pressure in one direction and opens easily in the other direction.

The non-return valve can thus resist atmospheric pressure with a high vacuum in the desiccants reservoir and can be actuated by a minimal force directed towards the inside of the heat exchanger.

More particularly, the invention provides a self-cooling container comprising a first cavity containing a product to be cooled, a second cavity forming a heat exchanger and containing a refrigerant and its vapor, a third cavity containing means of pumping by adsorption of said vapor and means of communicating said second cavity to said third cavity, characterized in that the second and third cavities have a common wall integrating the communication means, and in that said communication means are constituted by a non-return valve adapted to resist the pressure exerted on the second-cavity side and opening by the action of a force exerted on the third-cavity side.

According to one characteristic, the valve is constituted by a solid cover situated on the second-cavity side and closing an opening in the common wall of the second and third cavities.

According to the embodiments, the communication means also comprise a valve seal, constituted by a deformable gasket situated between the solid cover and the common wall of the second and third cavities or by a vacuum-tight and tearable foil covering the solid cover and bonded to the common wall of the second and third cavities.

According to one characteristic, the valve is actuated by a push rod transmitting a movement of at least one portion of the wall of the third cavity opposite to the wall containing the communication means.

According to a special characteristic, the push rod is an open hollow tube allowing the vapor of the refrigerant to travel inside said rod.

According to an advantageous embodiment variant, the push rod contains means of opening the valve in two stages, a first position of the valve delimiting a restricted passage for the vapor of the refrigerant and a second position of the valve developing an enlarged passage for the vapor of the refrigerant.

According to the embodiments, the ratio of the mass of the valve to the surface area of the tube of the push rod is between 0.5 and 2 g/cm$^2$, and/or the push rod contains a stop situated at a distance of between 2 and 5 mm from the valve.

According to an advantageous embodiment variant, the second cavity contains a liquid-gas state separation device arranged around the valve.

According to one characteristic, the second cavity is of a substantially conical shape such that its sectional surface decreases from base to apex.

According to one characteristic, the second cavity is delimited by the bottom of the first cavity and the cover of the third cavity.

According to the embodiments, the first and third cavities constitute two separate assembled cans or the first and third cavities constitute compartments of a single can.

In one application, the container is presented in the form of a beverage can.

The characteristics and advantages of the present invention will become apparent from the description which follows, given by way of illustrative and non-limitative example, and with reference to the drawings.

DETAILED DESCRIPTION OF PREFERRED EMBODIMENTS

Figure 1:
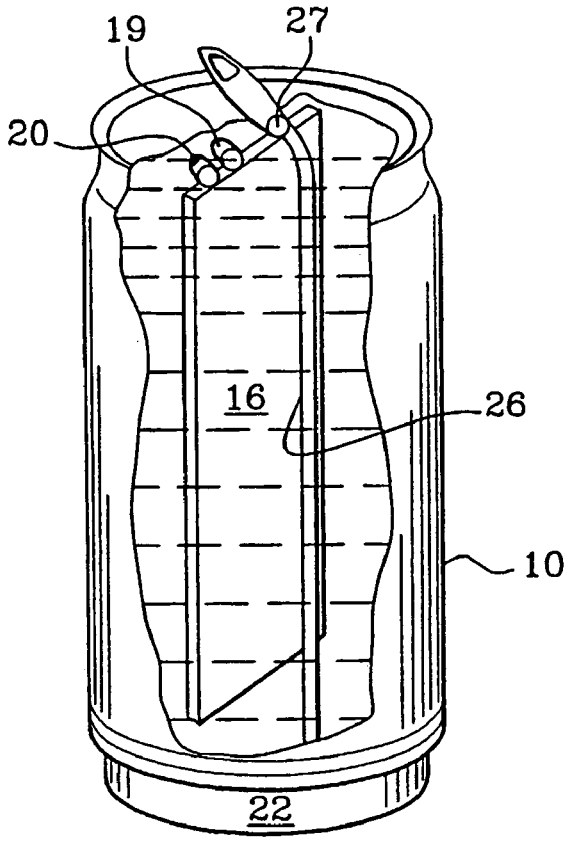
FIG. 1, already described, is a diagram of a self-cooling beverage can according to one embodiment of the prior art.
Figure 2B:
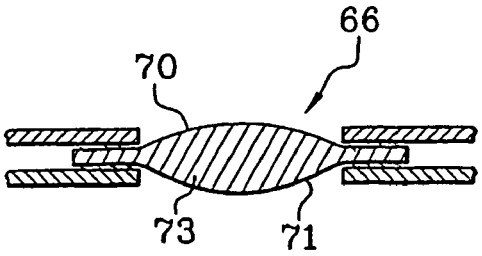
FIGS. 2*a* and 2*b*, already described, are respectively a general diagram of a self-cooling beverage can and a detailed diagram of the communication means according to the prior art.
Figure 2A:
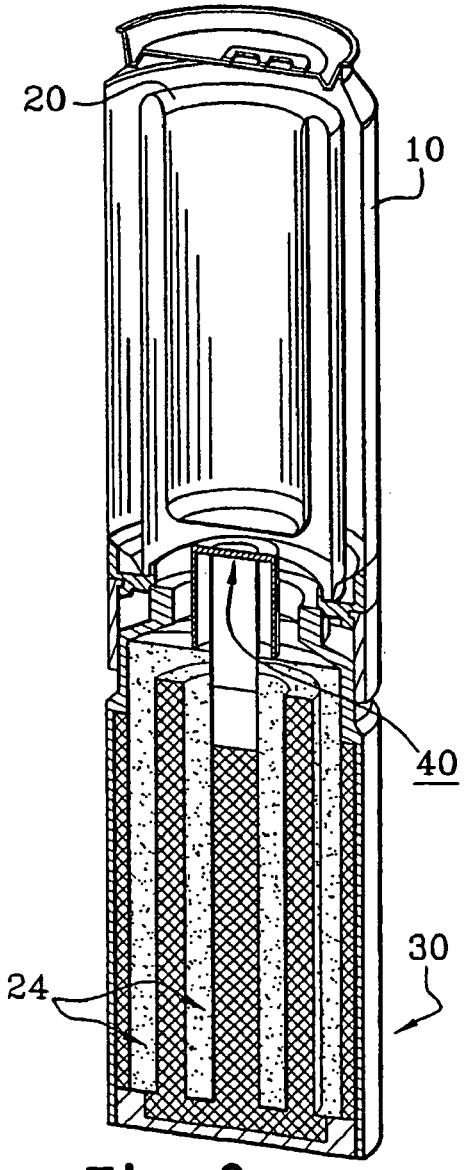
Figure 3A:
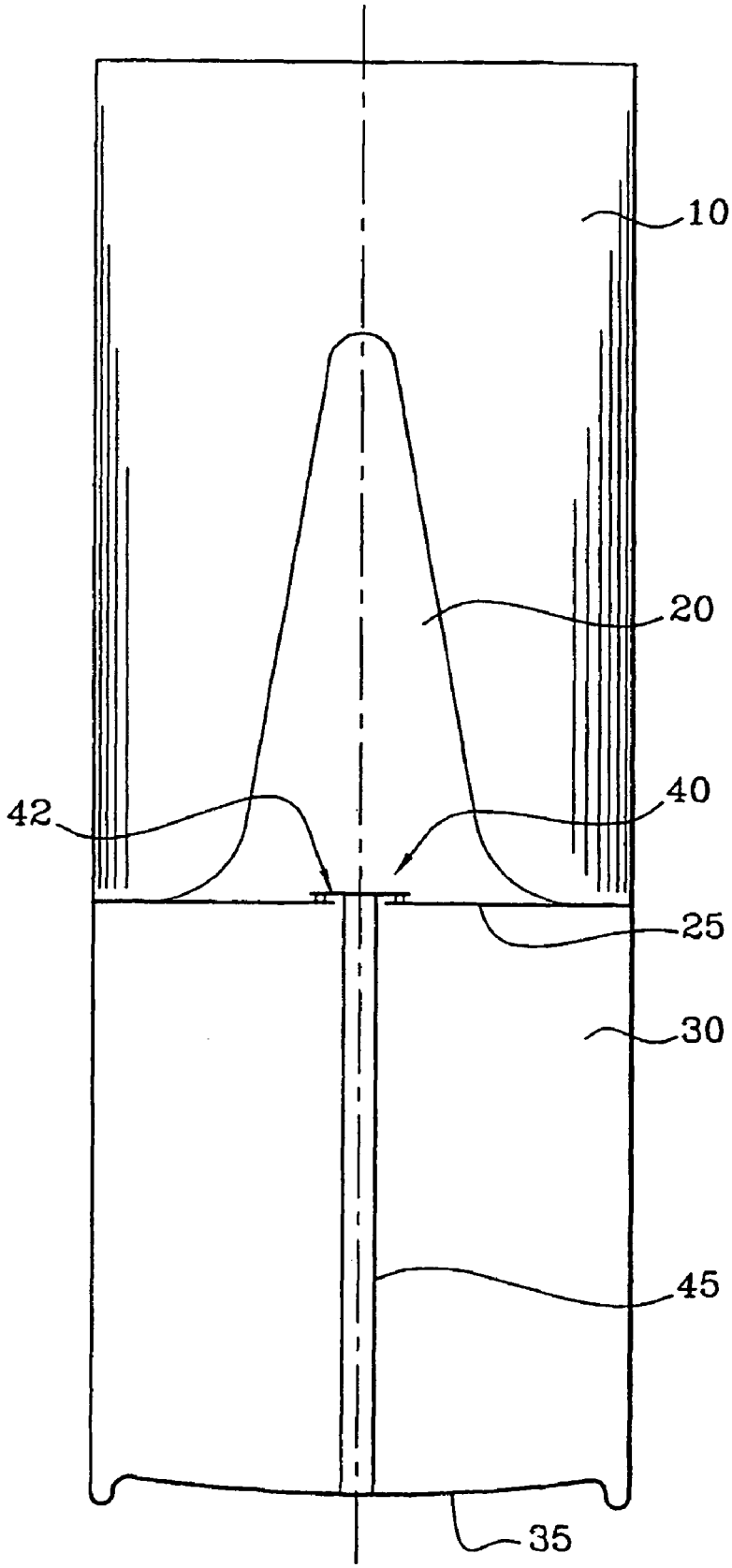
FIGS. 3*a* and 3*b* are schematic views of the device according to the invention with the valve in the closed position and open position respectively.
Figure 3B:
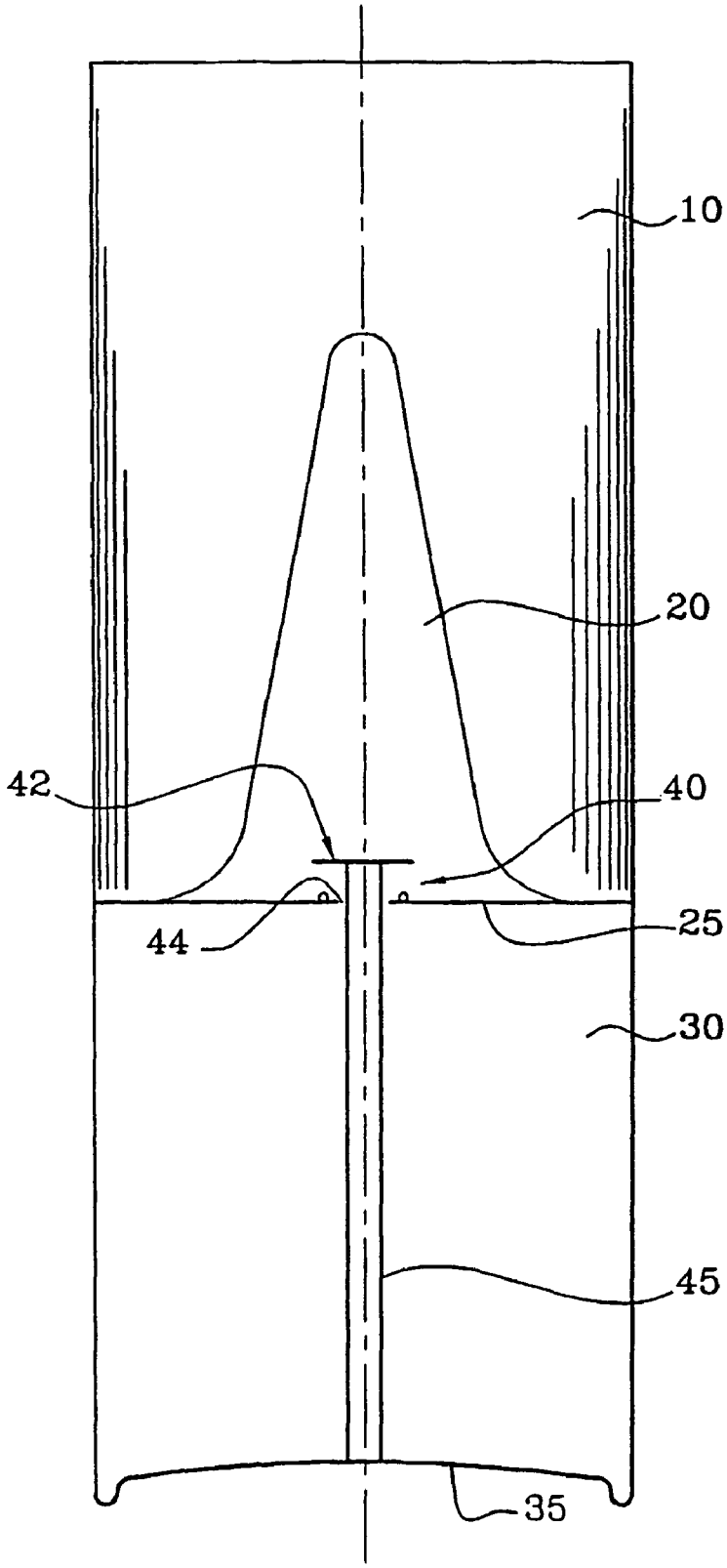

In the description which is given hereafter FIGS. 3*a* and 3*b* illustrate schematically a beverage container according to the invention. The beverage container according to the invention comprises a first cavity 10 containing a consumer beverage to be cooled, a second cavity 20 forming a heat exchanger and containing a refrigerant the evaporation of which produces the cooling and a third cavity 30 containing means of pumping by adsorption of the vapor of the refrigerant of the second cavity 20. The first 10 and second 20 cavities have a common wall which constitutes a heat exchanger. This common wall advantageously has a conical shape with ribs in order to encourage the exchange of heat by convection in the first cavity 10.

The container according to the invention moreover requires means of triggering the cooling reaction. This reaction is triggered by connecting the second 20 and third 30 cavities to each other, thus causing the evaporation of the refrigerant of the second cavity 20 the vapor of which is pumped by a desiccant contained in the third cavity 30. In order to guarantee a good pumping efficiency of the desiccant, it is necessary that the third cavity 30 be assembled and closed under vacuum, with a vacuum of less than 1 mbar and preferentially less than 0.1 mbar.

Thus, according to the invention, the means 40 of connecting the second cavity 20 to the third cavity 30 are integrated in a wall 25 common to said cavities. It is therefore sufficient to create an opening 44 in this common wall 25 to trigger the cooling.

According to the invention, the communication means 40 are constituted by a non-return valve 42 closing an opening 44 in the common wall 25 of the second and third cavities. This valve 42 has the characteristic of being able to open only towards the outside of the third cavity 30, i.e. towards the inside of the second cavity 20. The valve 42 is able to resist the pressure exerted on the second-cavity side 20 and opens by the action of a force exerted on the third-cavity side 30. By way of guidance, this opening force exerted on the valve 42 can be between just 1 and 10 Newton.

FIGS. 3*a* and 3*b* illustrate more specifically the valve according to the invention in the closed and open positions respectively.

The cooling reaction is triggered by the movement of the valve 42 towards the inside of the second cavity 20. The non-return valve 42 is actuated by a push rod 45 transmitting a movement of at least one portion of the wall 35 of the third cavity 30 opposite the wall 25 comprising the communication means 40. The deformable wall 35 of the third cavity 30 can be constituted by a dome-shaped structure resistant to the atmospheric pressure applied to the outside of the third cavity 30 which is assembled and closed under vacuum. This dome-shaped structure 35 can however be turned inwards under the action of a force located at the centre of the dome, such as a force of 20 to 30 Newton applied to a central surface area of 1 cm$^2$. This force serves mainly to turn the dome inwards, which causes the push rod to move. The force required to open the valve 42 is negligible compared with the deformation force of the dome of the wall 35 of the third cavity 30.

Figure 4:
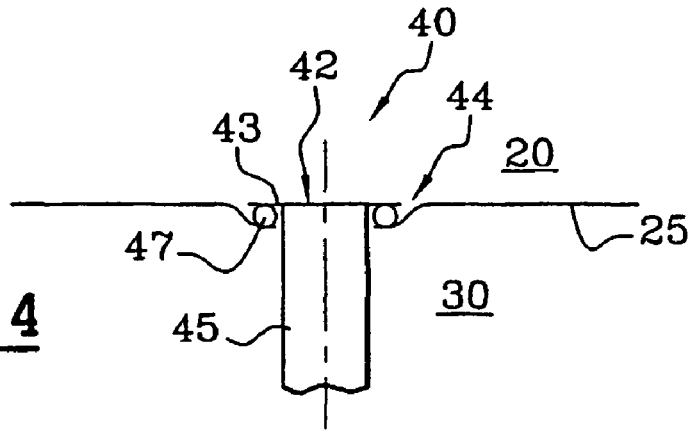
FIG. 4 is a schematic view according to a first embodiment of the valve according to the invention.
Figure 5:
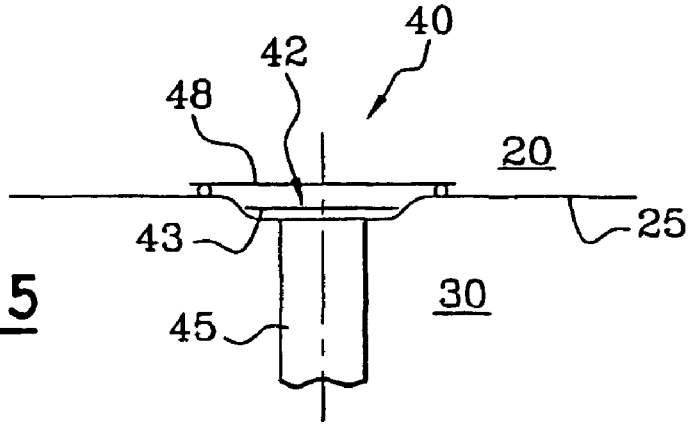
FIG. 5 is a schematic view according to a second embodiment of the valve according to the invention.

FIGS. 4 and 5 illustrate schematically a first and a second embodiment of the non-return valve according to the invention. The valve 42 is constituted by a solid cover 43 situated on the second-cavity side 20 and closing an opening 44 of the common wall 25 of the second 20 and third 30 cavities. The solid cover 43, such as a metal disk, has dimensions which are slightly greater than those of the opening 44 of the common wall 25.

According to a first embodiment, illustrated in FIG. 4, the communication means 40 moreover comprise a valve seal 42 constituted by a deformable gasket 47, such as of vacuum grease or an elastomer, situated between the solid cover 43 and the common wall 25 of the second and third cavities.

According to a second embodiment, illustrated in FIG. 5, the communication means 40 also comprise a valve seal 42 constituted of a thin vacuum-tight and tearable foil 48, such as an aluminium foil 2/100 mm thick, covering the solid cover 43 and bonded to the common wall 25 of the second and third cavities.

The valve seal 42 offers only a weak resistance to the pressure exerted by the solid cover 43 when the valve 42 is actuated by the push rod 45. This additional weak resistance, of a few hundreds of grams, corresponds simply to the debonding of the deformable gasket 47 or to the tearing of the thin foil 48. The pressure prevailing in the second cavity 20, of a few tens of mbar, only adds a few tens of grams to the resistance of the seal, considering a surface area of the valve cover of less than 1 $cm^2$.

The non-return valve 42 constituting the communication means 40 of the second 20 and third 30 cavities of the container according to the invention has the characteristic of opening in one direction only, from the third towards the second cavity.

Thus, this function of the valve 42 considerably facilitates the manufacture of the beverage container according to the invention by allowing the handling of the different elements of the container at atmospheric pressure, without requiring an excessive effort to trigger the cooling reaction. In particular, the valve 42 remains closed if the third cavity 30, with a cover 25 integrating the valve 42, is exposed to atmospheric pressure when this third cavity is already under vacuum.

Moreover, in the case of a pasteurized beverage with its container, the one-way opening of the valve 42 has the advantage of supporting the rise in pressure in the second cavity 20 during the rise in temperature, up to approximately 80 to 90° C., required for pasteurization.

Figure 6:
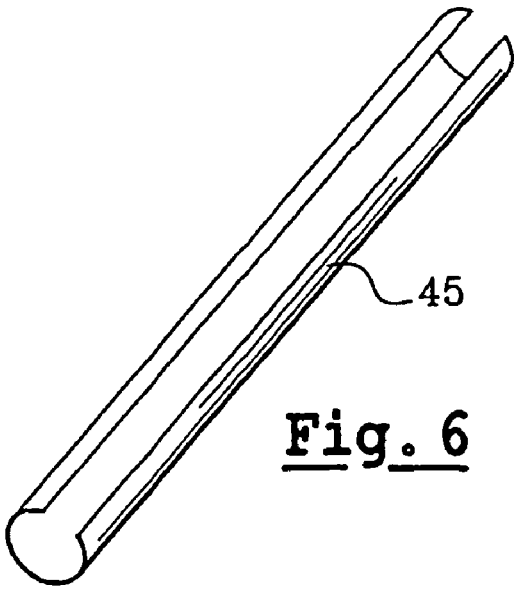
FIG. 6 is a schematic view of a push rod for the implementation of the valve according to the invention.

FIG. 6 illustrates schematically the push rod actuating the valve of the communication means of the beverage container according to the invention. The push rod 45 is advantageously constituted by an open hollow tube which therefore allows the vapor of the refrigerant to travel inside said rod between the second cavity and the third cavity. The rod 45 can be obtained from a sheet of rolled metal in the form of an open tube.

Upon the actuation of the valve 42 allowing the communication of the second and third cavities to each other, the pumping reaction of the vapor of the refrigerant starts immediately. The refrigerant boils violently under the action of the depression. This boiling causes projections of drops of refrigerant which, if they enter the third cavity containing the desiccant, can be harmful to its efficiency.

Figure 7:
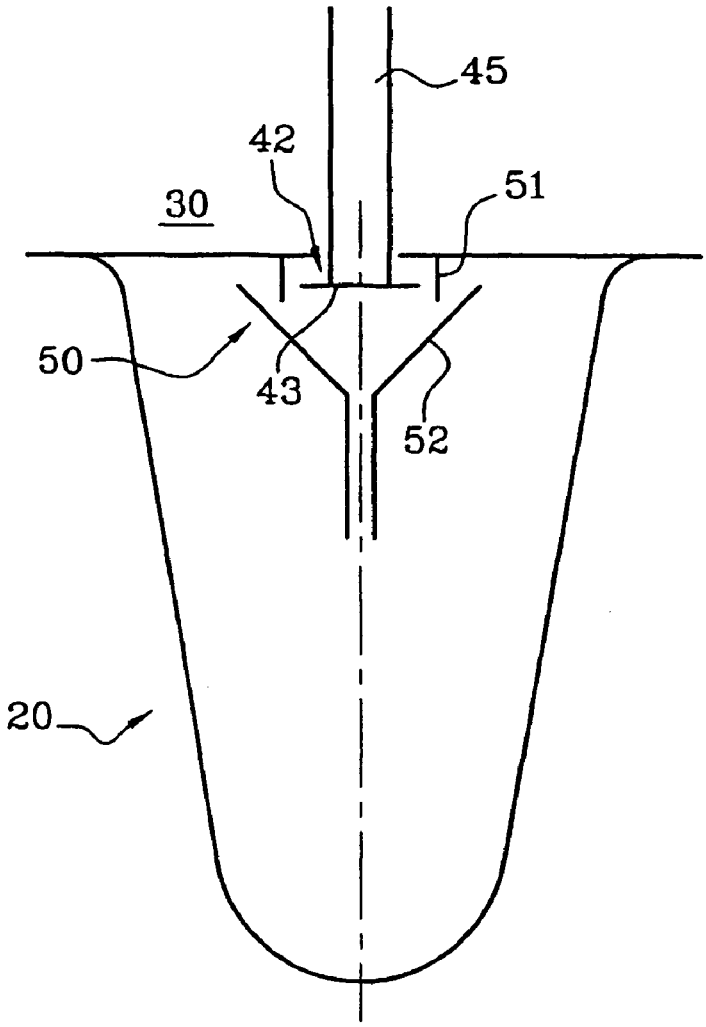
FIG. 7 is a schematic view of a liquid-gas state separation device arranged in the beverage container according to the invention.

In order to overcome this drawback, it is advantageous to integrate a liquid-gas state separation device in the second cavity 20, around the non-return valve 42 according to the invention, as illustrated in FIG. 7. The container must be positioned with the second cavity orientated downwards during cooling.

The state separator 50 comprises a vapor deflector which is composed of at least one wall forming baffle means 51 which imposes one or more abrupt changes of direction on the vapor flow. The vapor molecules have a very short mean free path, of the order of a micrometre, which means that they can change direction very rapidly. On the other hand, the drops of liquid have a mass such that they are entrained by their inertia and therefore separated from the gas flow. This mechanism advantageously allows a liquid-gas separation without major slowing of the vapor flow and does not therefore require the occupation of a substantial volume.

The state-separation device 50 also comprises, in addition, a drop collector 52 which makes it possible to redirect the liquid drops which have been separated from the vapor gas flow towards the bottom of the cavity of the heat exchanger 20. The collector 52 comprises a funnel and at least one discharge tube for the drops. The funnel can advantageously contribute to the formation of the baffle means 51 of the vapor deflector.

Preferentially, the discharge tube for the drops of the collector 52 has a length greater than or equal to the pressure drop of the vapor in the baffle means 51 in order to avoid the projection of drops through said discharge tube. This pressure drop is advantageously measured in water volume height. Considering, for example, a pressure drop of the vapor of 1 mb (corresponding to 1 cm water column height) the tube will be at least 1 cm long.

Such a state-separation device reaches its limits however if the rate of discharge of the vapor is too great. When the cooling reaction is triggered, the pressure difference between the second and third cavities is several tens of millibars, leading to a rate of discharge of the vapor such that the state-separation device can be saturated by the droplets of refrigerant entrained with the vapor.

In order to limit this effect, according to a variant of the invention, the non-return valve 42 is opened in two stages.

In the first position, the cover 43 of the valve 42 is kept in contact with the tube of the push rod 45 by the overpressure of the second cavity 20 relative to the third cavity 30. The mass of the cover 43 of the valve is such that it remains in contact with the push rod 45 and thus limits the passage of vapor of the refrigerant towards the third cavity to travel in the hollow of the rod through a limited lateral opening.

When the overpressure of the second cavity relative to the third cavity becomes less than approximately 1 to 3 mbar, the vapor flow-rate falls and the cover 43 of the valve 42 drops into the second cavity 20 thus releasing a larger opening for the passage of the vapor. As mentioned previously, the cooling is triggered with the third cavity towards the top of the container.

The level of overpressure, and therefore the vapor flow-rate, for which the full opening of the valve 42 is operated can be adjusted by the mass of the valve, and more specifically of the solid cover 43. The ratio of the mass of the cover to the surface area of the tube of the push rod can advantageously be between approximately 0.5 and 2 $g/cm^2$. A typical overpressure value can be 2 mbar with a surface area of the tube of the push rod of 0.3 $cm^2$, i.e. a mass of the cover of the valve of 0.6 g.

Figure 8:
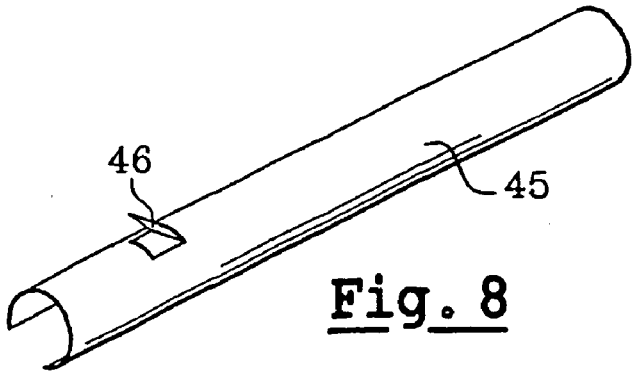
FIG. 8 is a schematic view of a push rod for the implementation of a two-stage opening of the valve according to the invention.

In order to better control the level of opening of the first position of the valve 42 in the first stage of a high vapor flow-rate, it can be expedient to create a stop 46 in the push rod 45, as illustrated in FIG. 8. Advantageously, this stop 46 is situated at a distance of approximately 2 to 5 mm from the end of the rod in contact with the valve cover. The restricted opening of the valve is thus ensured over a height of 2 to 5 mm by the lateral opening of the push rod and the complete opening of the valve is ensured by the whole section of tube.

Apart from the functionality of a one-way opening between the cavities forming the heat exchanger and the desiccants reservoir, the beverage container according to the invention has the advantage of allowing easy assembly.

Figure 9:
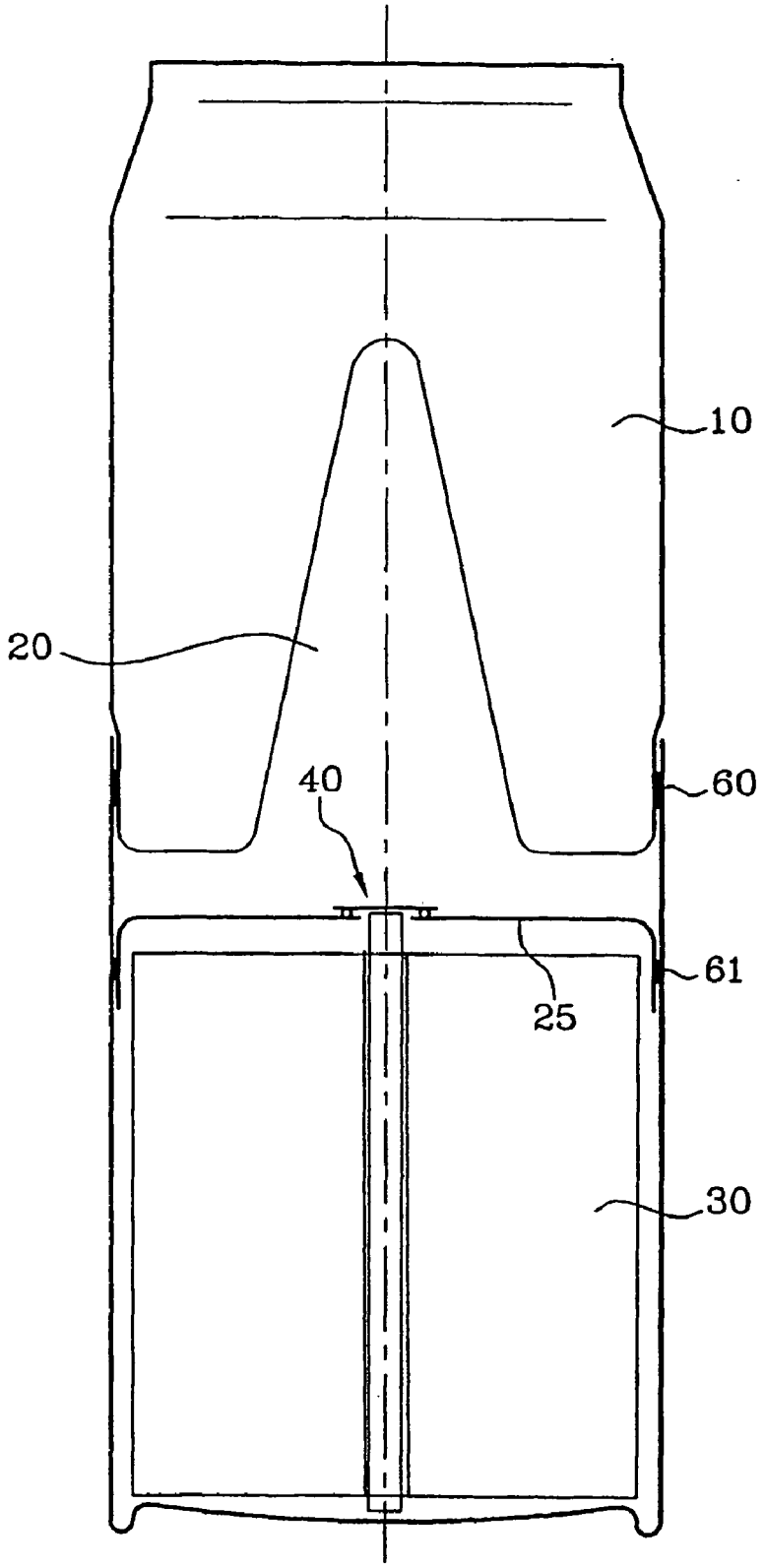
FIG. 9 is a schematic view of a beverages container according to a first embodiment of the invention.
Figure 10:
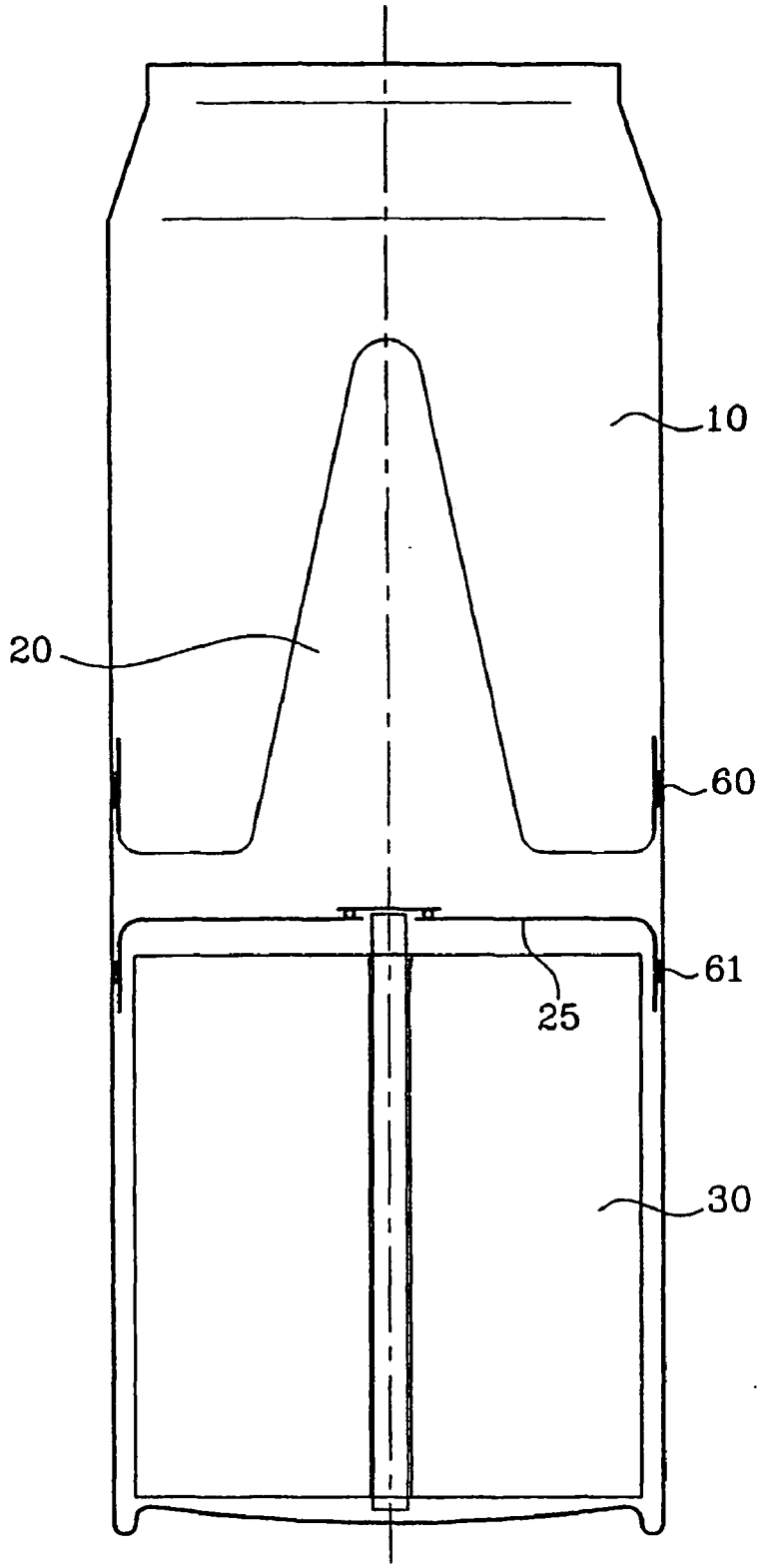
FIG. 10 is a schematic view of a beverage container according to a second embodiment of the invention.
Figure 11:
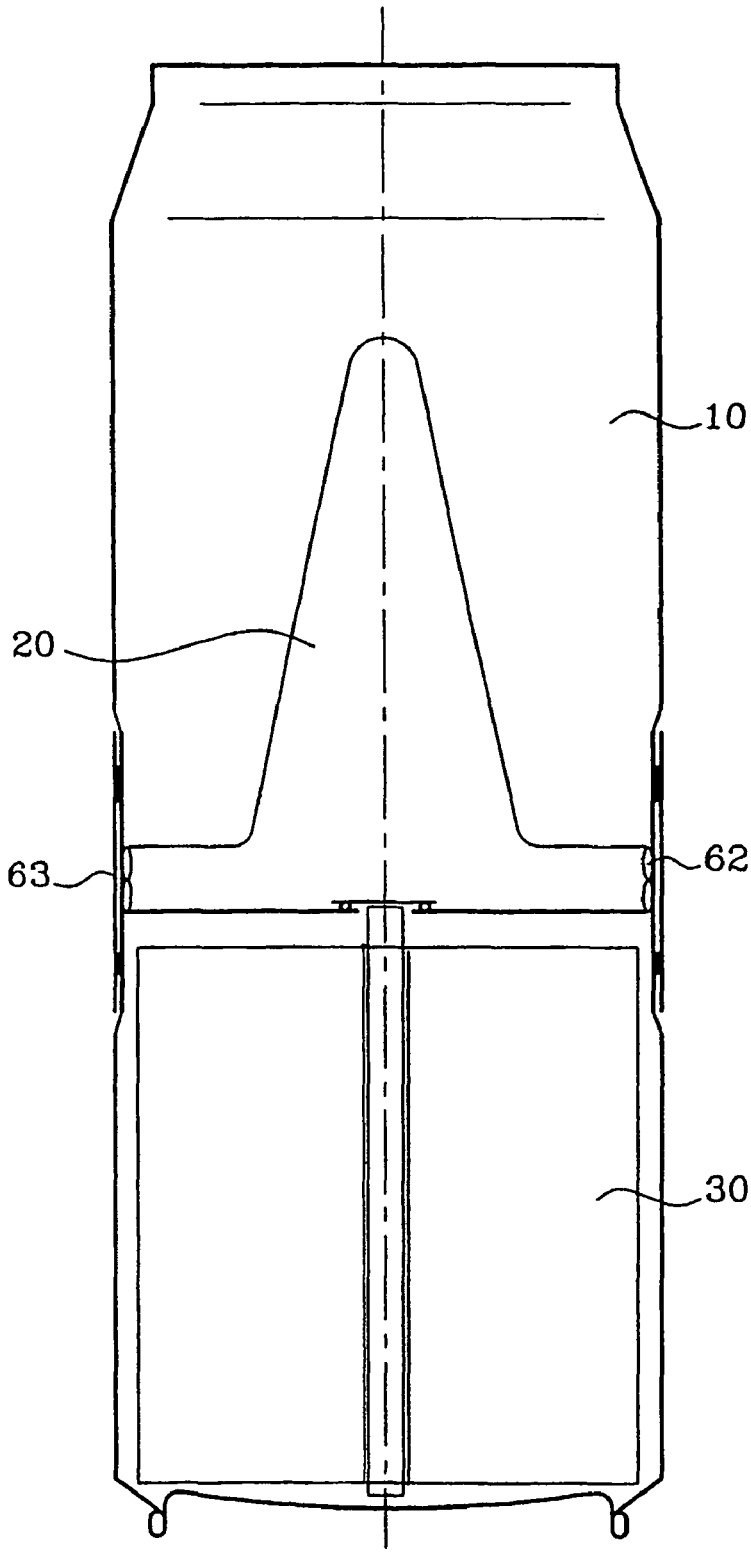
FIG. 11 is a schematic view of a beverage container according to a third embodiment of the invention.

FIGS. 9 to 11 illustrate different embodiments of such an assembly.

In particular, the second cavity 20 of the container does not require the production of an additional piece. The second cavity 20, forming the heat exchanger, is defined by a space delimited between the cover of the third cavity 30 and the bottom of the first cavity 10. The second cavity 20 is thus obtained during the assembly of the third cavity 30 with the first cavity 10, in a tight fashion.

According to a first embodiment, illustrated in FIG. 9, the first 10 and third 30 cavities are assembled by fitting together two cylinders by bonding or brazing 60.

The fitting of the third cavity 30 to the first cavity 10 is carried out after having arranged the cover 25 closing the reservoir of desiccant on the third cavity 30. It will be recalled that this cover 25 integrates the communication means 40. This cover can also be bonded or brazed 61 to the inside of the cylinder forming the third cavity 30.

According to a second embodiment, illustrated in FIG. 10, the first 10 and third 30 cavities of the container constitute the compartments of a single can. The separation cover 25 between the second 20 and third 30 cavities is introduced into the can and fixed by bonding or brazing 61 to the walls of the can. The common wall of the first 10 and second 20 cavities, forming the heat exchanger, is also introduced into the can and fixed by bonding or brazing 60, after the refrigerant has been introduced.

A brazing 60, 61, with tin for example, can be carried out by localized induction heating. Eddy currents are induced by a coil surrounding the assembly area. This coil is fed by a high-frequency alternating current. This technique allows a precise and rapid assembly.

According to a third embodiment, illustrated in FIG. 11, the first 10 and third 30 cavities are assembled by crimping 62 two cylinders. For example, the wall common to the second and third cavities is crimped to the wall common to the first and second cavities, the assembly being completed by a cylindrical ring 63, bonded or brazed, creating the junction between the two cylinders.

The embodiment variants described above are presented by way of illustration but in a non-limitative fashion in order to show the flexibility of the assembly of the container according to the invention.

These embodiment variants described can moreover be combined in different ways.

What is claimed is:

1. A self-cooling container comprising a first cavity containing a product to be cooled, a second cavity forming a heat exchanger and containing a refrigerant and its vapor, a third cavity containing means of pumping by adsorption of said vapor and means of communicating said second cavity to said third cavity, characterized in that the second and third cavities have a common wall separating said second and third cavities with an internal volume of said second cavity on one side of said common wall and an internal volume of said third cavity on an opposite side of said common wall, said common wall integrating the communication means, and in that said communication means are constituted by a non-return valve adapted to resist the pressure exerted on the second-cavity side and opening by the action of a force exerted on the third-cavity side.

2. The self-cooling container according to claim 1, wherein the valve is constituted by a solid cover situated on the second-cavity side and closing an opening of the common wall of the second and third cavities.

3. The self-cooling container according to claim 2, wherein the communication means also comprise a valve seal constituted by a deformable gasket situated between the solid cover and the common wall of the second and third cavities.

4. The self-cooling container according to claim 2, wherein the communication means also comprise a valve seal constituted by a vacuum-tight and tearable foil covering the solid cover and bonded to the common wall of the second and third cavities.

5. The self-cooling container according to claim 1, wherein the valve is actuated by a push rod transmitting a movement of at least one portion of the wall of the third cavity opposite the wall containing the communication means.

6. The self-cooling container according to claim 5, wherein the push rod is an open hollow tube allowing the vapor of the refrigerant to travel inside said rod.

7. The self-cooling container according to claim 5, wherein the push rod contains means of opening the valve in two stages, a first position of the valve delimiting a restricted passage for the vapor of the refrigerant and a second position of the valve developing an enlarged passage for the vapor of the refrigerant.

8. The self-cooling container according to claim 7, wherein a ratio of the mass of the valve to the surface area of the tube of the push rod is between 0.5 and 2 $g/cm^2$.

9. The self-cooling container according to claim 6, wherein the push rod contains means of opening the valve in two stages, a first position of the valve delimiting a restricted passage for the vapor of the refrigerant and a second position of the valve developing an enlarged passage for the vapor of the refrigerant.

10. The self-cooling container according to claim 9, wherein z ratio of the mass of the valve to the surface area of the tube of the push rod is between 0.5 and 2 $g/cm^2$.

11. The self-cooling container according to claim 7, wherein the push rod contains a stop situated at a distance of between 2 and 5 mm from the valve.

12. The self-cooling container according to claim 1, wherein the second cavity contains a liquid-gas state separation device arranged around the valve.

13. The self-cooling container according to claim 1, wherein the second cavity has a substantially conical shape such that its sectional surface decreases from base to apex.

14. The self-cooling container according to claim 1, wherein the second cavity is delimited by the bottom of the first cavity and the cover of the third cavity.

15. The self-cooling container according to claim 1, wherein the first and third cavities constitute two separate assembled cans.

16. The self-cooling container according to claim 1, wherein the first and third cavities constitute compartments of a single can.

17. The self-cooling container according to claim 1, wherein it is presented in the form of a can for a consumer beverage.

* * * * *